US005423162A

United States Patent [19]

Chiu

[11] Patent Number: 5,423,162

[45] Date of Patent: Jun. 13, 1995

[54] AUTOMATIC PACKING AND SEALING MACHINE

[76] Inventor: Shao-Yi Chiu, No. 191, Yen Ping Road Sec. 3, Tou Nan Chen, Yun Lin Hsien, Taiwan, Prov. of China

[21] Appl. No.: 335,335

[22] Filed: Nov. 3, 1994

[51] Int. Cl.[6] ..... B65B 9/06

[52] U.S. Cl. ..... 53/550; 53/548; 53/562; 53/504; 53/503

[58] Field of Search ..... 53/504, 503, 550, 553, 53/548, 562

[56] References Cited

U.S. PATENT DOCUMENTS

| | | | |
|---|---|---|---|
| 3,405,501 | 10/1968 | Edelberg et al. | 53/550 |
| 3,469,368 | 9/1969 | Churchill et al. | 53/548 |
| 3,729,894 | 5/1973 | Stohlauist | 53/553 |
| 4,182,096 | 1/1980 | Ballestrazzi et al. | 53/553 |
| 4,369,613 | 1/1983 | Gess | 53/553 |
| 4,887,412 | 12/1989 | Takamura | 53/504 |
| 5,255,495 | 10/1993 | Kovacs | 53/504 |

*Primary Examiner*—Lowell A. Larson

*Assistant Examiner*—Gene L. Kim

*Attorney, Agent, or Firm*—Browdy and Neimark

[57] ABSTRACT

An automatic packing and sealing machine comprising a front conveyor set, a fast locating device for quickly adjusting and locating the front conveyor set and a sensing device for sensing an article passing therethrough. The sensing device employs a close contact block and a shade board connected therewith. The close contact block is upward swung by the passing article to make the shade board shade a close contact switch so as to actuate a sealing blade for sealing operation. An auxiliary film-pulling device is used to pull the plastic film so as to avoid that an excessively high article cannot be actually clamped by a clamping device and the plastic film packing the article loosen therefrom or the sealing portion is crimped. An elevator device is used to adjust the level of the sealing blade seat to suit various heights of the packed articles. The sealing blade has an arch joint portion which will not thrust the plastic film during the sealing operation.

1 Claim, 14 Drawing Sheets

AUTOMATIC PACKING AND SEALING MACHINE

BACKGROUND OF THE INVENTION

The present invention relates to an automatic packing and sealing machine.

A conventional automatic packing and sealing machine mainly includes a plastic film-feeding system, a packing system, a sealing system and a conveying system. The plastic film-feeding system includes a first roller shaft and a second roller shaft which are disposed between two lateral walls. A supporting shaft is passed through each of the roller shafts and two bearings are fitted on two ends of the supporting shaft, permitting each of the roller shafts to freely rotate thereabout. Two adjusting sleeve members are symmetrically freely slidably fitted on the second roller shaft. On an edge of each of the adjusting sleeve members is formed thread holes, whereby screws are screwed into the thread holes to secure the adjusting sleeve member on the second roller shaft. One end of a tension-adjusting shaft penetrates the lateral wall and is formed with a thread section which is cut with a fissure. A coil spring having a central abutting plate is fitted with the thread section with the central abutting plate inserted in the fissure. An outer surface of the coil spring contacts with an inner surface of a cover member. The cover member has a central through hole and a peripheral portion formed with multiple U-shaped recesses, whereby several nuts are screwed on the tension-adjusting shaft to associate the cover member witch a flange plate of the lateral wall. A fixing means is disposed above the flange plate and is composed of a C-shaped seat member, a spring and a fixing rod. The spring is disposed between an upper side of the C-shaped seat and an annular projection of the fixing rod, whereby the spring is able to force the fixing rod into the U-shaped recess of the cover member. A stretching lever is disposed between the lateral walls and has a thread end portion secured on the lateral wall by nuts and a ball end portion.

The packing system includes two slide rails which are disposed on a support body. Multiple linear bearings are fixed on a frame body of a front conveying belt corresponding to the slide rails. A thread sleeve is fixed on a rear portion of the frame body and one end of a thread rod is screwed in the thread rod. The other end of the thread rod is connected with a wheel, whereby when rotating the wheel, the whole conveying belt structure can be moved back and forth. A lower triangular turning guiding board is disposed on a transverse seat located on the frame body. An upper triangular turning guiding board is disposed on an upper transverse rod. A substantially U-shaped stretching lever is disposed on one side of the upper turning guiding board. A blowing tube is diagonally fixed on the frame body under the front conveying belt assembly. The blowing tube is formed with multiple blowing holes, whereby an operater is able to blow diagonally inwardly through the blowing holes in the direction parallel to a diagonal side of the lower triangular turning guiding board.

The sealing system and conveying system include an upper and a lower substantially U-shaped swinging arms which are disposed on two sides of the rear end of the support body. The upper and lower swinging arms are pivotally connected with each other. Two pairs of opposite sensing switch seats are disposed at a front end and on two sides of the upper swinging arm. Sensing switches are respectively disposed on the sensing switch seats. The transverse and longitudinal sealing blades are fixed under the upper swinging arm by screws. On two sides of each of the sealing blades are disposed activating plates which are connected by a substantially U-shaped connecting seat. A pair of opposite sensing plates are fixed above the left and right connecting seats. The left and right connecting seats are formed with through holes through which a guiding rod of the upper swinging arm is passed. A spring is fitted on the guiding rod and two nuts are secured at an upper end of the guiding rod so as to buffer vertical reciprocating movement of the activating plates, whereby during the sealing process, the blowing tube disposed under the front conveying belt assembly is used to blow air into the plastic film to expand the plastic film on the upper turning guiding board and permit the article to be packed on the front conveying belt assembly closer to the transverse sealing blade for saving material and making the package more compacted, and whereby during the conveying process, if the article does not completely pass through the transverse sealing blade or is too close to the longitudinal sealing blade or an unnecessary article or the operator incautiously extends his hand into a position under the sealing blade, when the upper swinging arm is moved downward, before the sealing blades touch the article, the activating plates beside the blades will previously touch the article and be moved upward, so that the sensing plates connected with the connecting seats of the activating plates will ascend along therewith and get close to the sensing switches, making the same sense and emit a signal so as to emergently stop the sealing system for ensuring the safety of the operator, reducing loss of the article and protect the packing and sealing apparatus.

Several shortcomings exist in the above arrangements as follows:

1. The position of the front conveyor set must be frequently adjusted to suit various articles. The adjustment is accomplished by means of a rotary wheel and a cooperative thread rod which rotarily drives the rotary wheel. Such operation is quite laborious and time-costing.
2. The sealing blade is composed of a longitudinal sealing blade member and a transverse sealing blade member connected therewith. A connection portion between the two blade members is sharp and tends to thrust through the plastic film during the sealing operation. This will lead to undesired quality of packing of the article.
3. An electric eye is used to sense the article so as to control the sealing blade of the rear conveyor set to seal the plastic film. However, the electric eye is sensitive only to opaque article while failing to effectively sense a transparent article. Therefore, the sealing blade often fails to seal the plastic film.
4. When packing a relatively high article, the upper triangular board of the front conveyor set can be lifted up by means of the adjusting seat, whereby the plastic film can be properly stretched open and the article conveyed by the front conveying belt can easily pass therethrough. However, the sealing blade of the rear conveyor set is pivotally connected on a blade seat which is fixed on the main body of the machine, so, that when packing the relatively high article, the same is liable to touch the sealing blade. This will disable the sealing blade from performing the sealing operation.

5. When packing a relatively high article, the upper and lower plastic films passing through the upper and lower triangular boards will be spaced by an increased distance. Accordingly, when the sealing blade thermally seals the upper and lower plastic films, the angle contained thereby is increased and the plastic films tend to slightly contract toward the article. This will lead to crimps of the plastic films after sealed. Moreover, the inward contracting plastic films will result in that the clamping chain cannot clamp the plastic films.

SUMMARY OF THE INVENTION

It is a primary object of the present invention to provide an automatic packing and sealing machine which includes a close contact sensing means composed of a close contact block and a shade board instead of the electric eye, whereby when an article passes through the close contact block, the plastic film packing the article is cut and sealed. Therefore, a transparent article or other hardly sensible articles can be easily sensed to achieve an actually sealing effect.

It is a further object of the present invention to provide the above packing and sealing machine, wherein a film pulling mechanism is provided to reduce the angle contained by the upper and lower plastic films so that the sealing operation can be smoothly performed without creating any crimp on the plastic films.

It is still a further object of the present invention to provide the above packing and sealing machine in which an elevator means is provided on each lateral side of the packing and sealing machine, whereby a movable seat can ascend or descend along a thread rod to adjust the height of the blade seat according to the height of the article. Therefore, various kinds of articles with different heights can suitably pass through the sealing blade to be packed and sealed thereby.

It is still a further object of the present invention to provide the above packing and sealing machine which includes a fast locating means composed of a locating seat, a cooperative locating lever, a connecting fixing plate and a locating ring. The main body of the locating lever contacts with the steel balls in the locating seat at multiple points so that the front conveyor set can be easily and fast moved. In addition, the distance between the notches of the locating lever is smaller than and in proportion to the distance between the screws of the locating seat so that the present packing and sealing machine can be quickly located and microadjusted.

It is still a further object of the present invention to provide the above packing and sealing machine, wherein the connection portion between the longitudinal and transverse sealing blade members is arched so that the plastic film will not be thrust thereby and a good quality of packing can be ensured.

The present invention can be, best understood through the following description and accompanying drawings, wherein:

DETAILED DESCRIPTION OF THE PREFERRED EMBODIMENT

Figure 1:
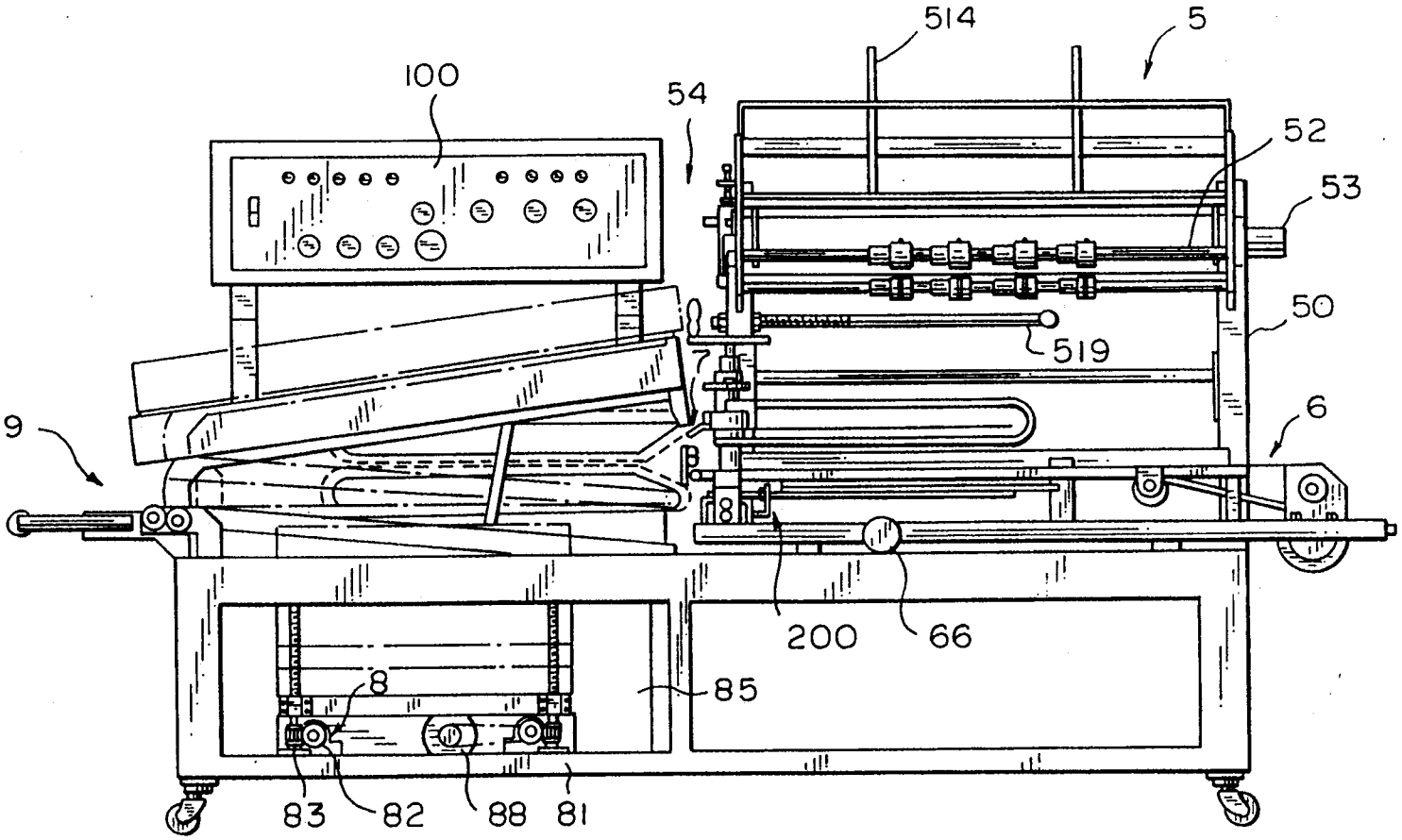
FIG. 1 is a front view of the packing and sealing machine of the present invention.

Please refer to FIG. 1. The automatic packing and sealing machine of the present invention includes a film-feeding system 5, a front conveyor set 6, a sensing means 7, an elevator means 8, a rear conveyor set 9, a fast locating means 66, a control means 100 and an auxiliary film-pulling means 200.

Figure 2:
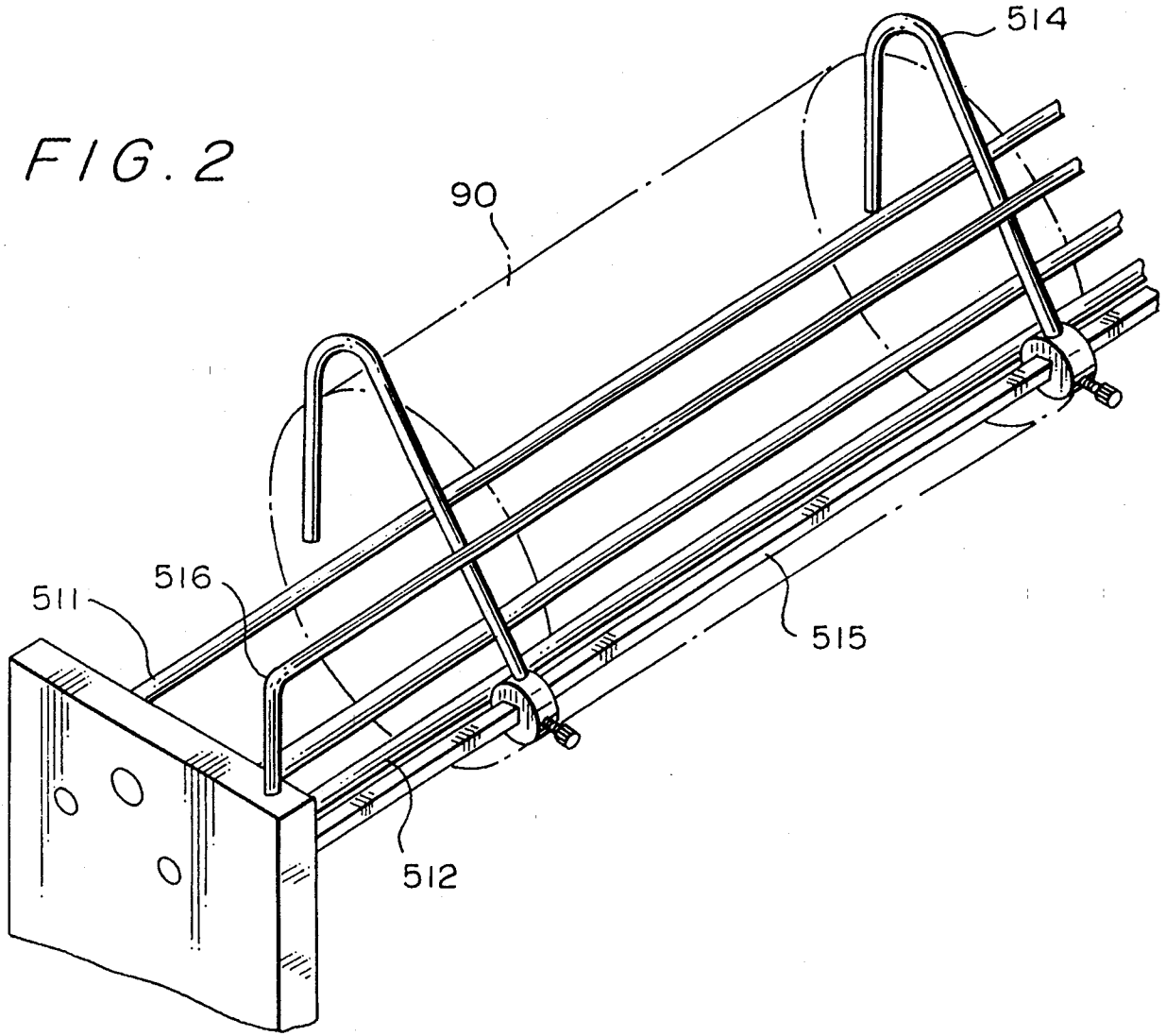
FIG. 2 is a perspective view of the plastic film support of the present invention.
Figure 3:
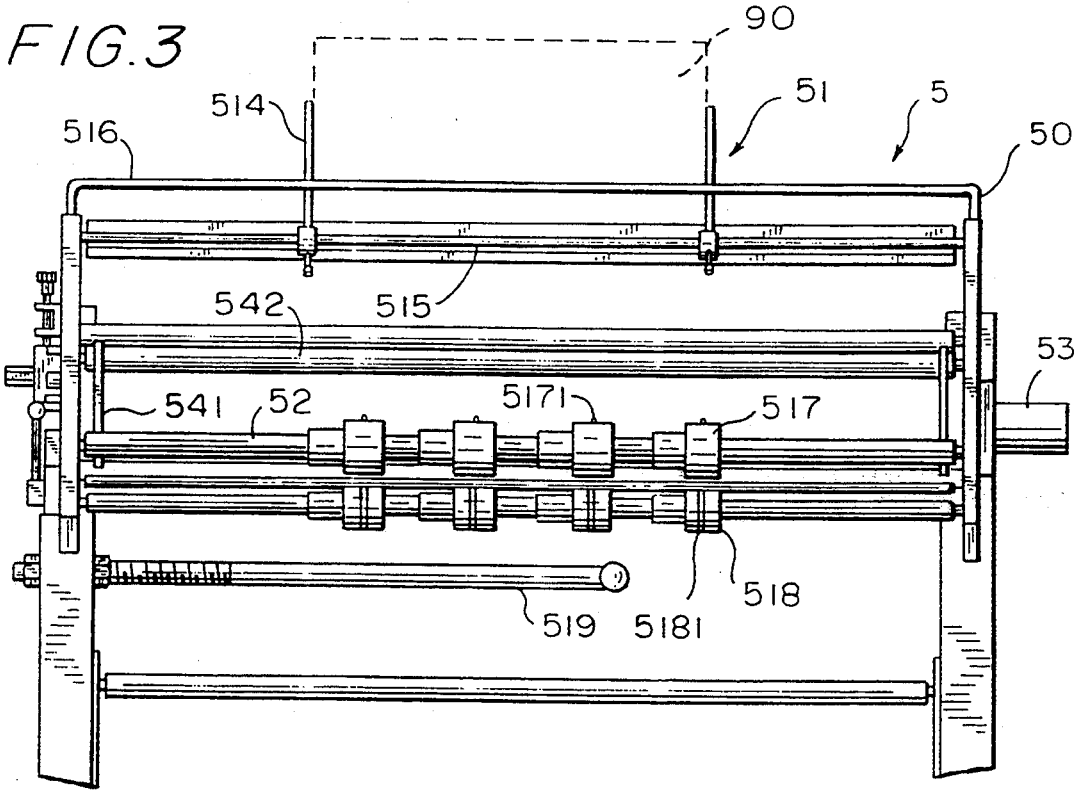
FIG. 3 is a front view of the plastic film-feeding system of the present invention.
Figure 4:
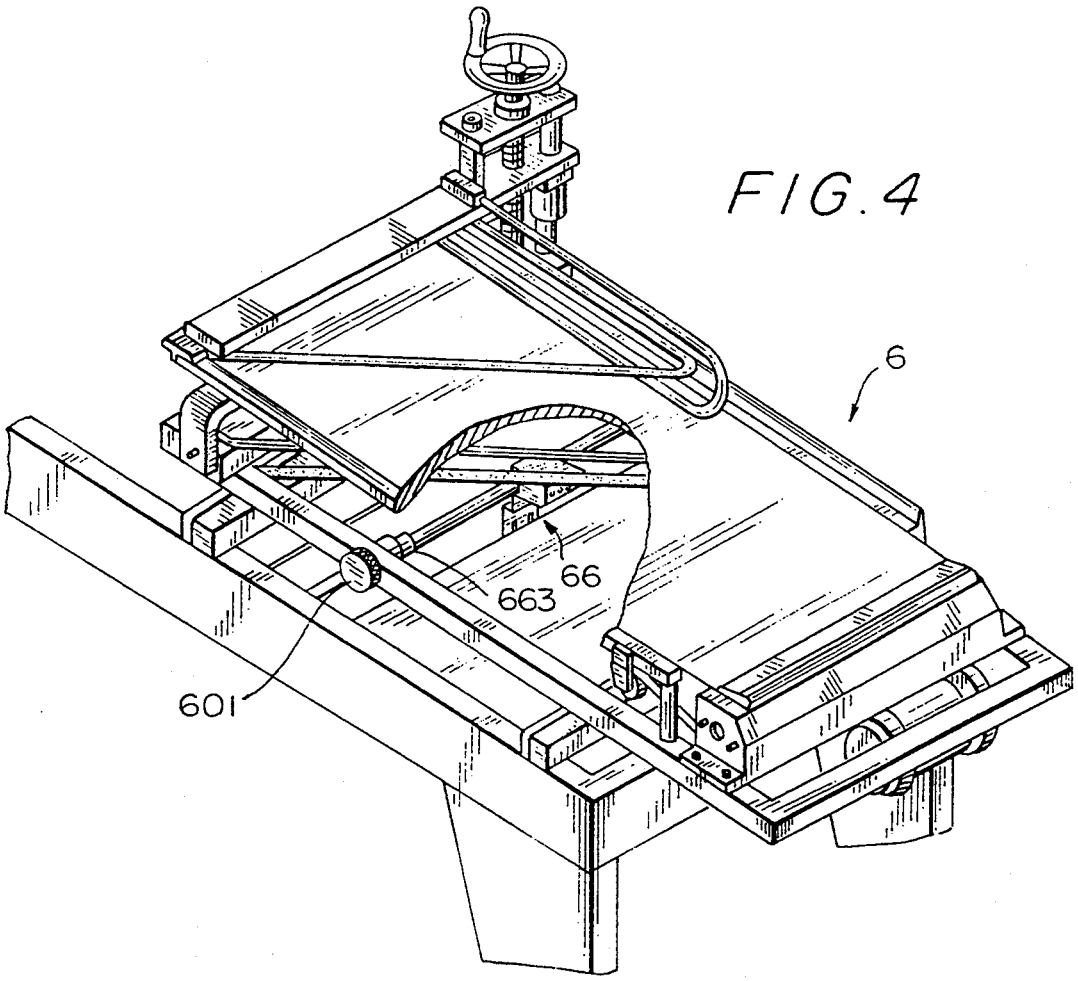
FIG. 4 is a perspective partially sectional view of the front conveyor set of the present invention.
Figure 5:
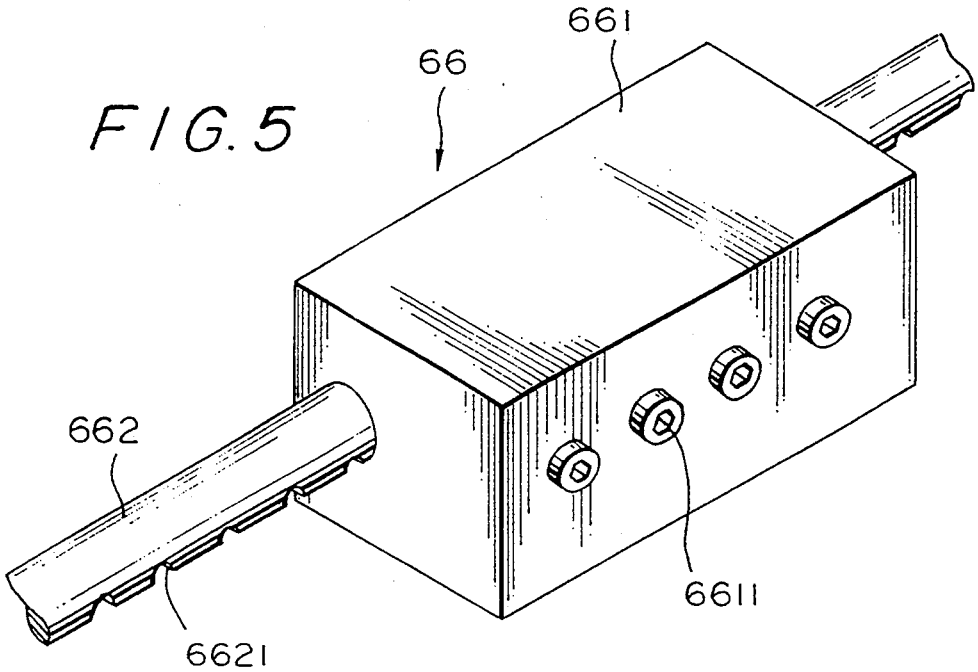
FIG. 5 is a perspective view of a part of the fast locating means of the present invention.
Figure 6:
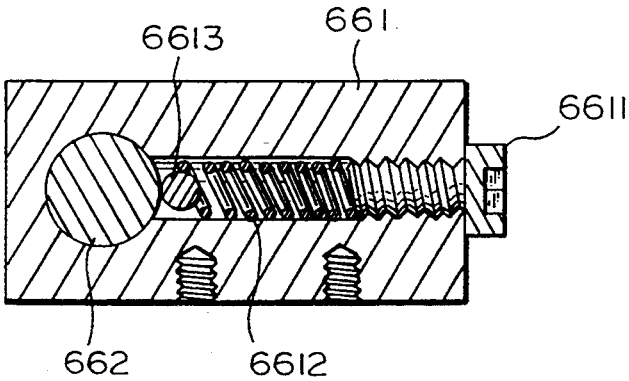
FIG. 6 is a sectional view of a part of the fast locating means thereof.
Figure 7:
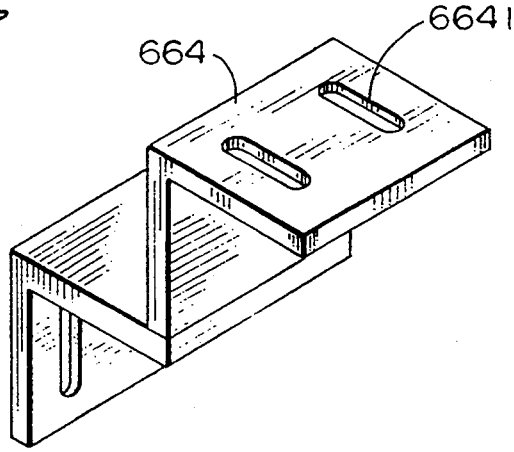
FIG. 7 is a perspective view of the connecting plate of the fast locating means thereof.
Figure 8:
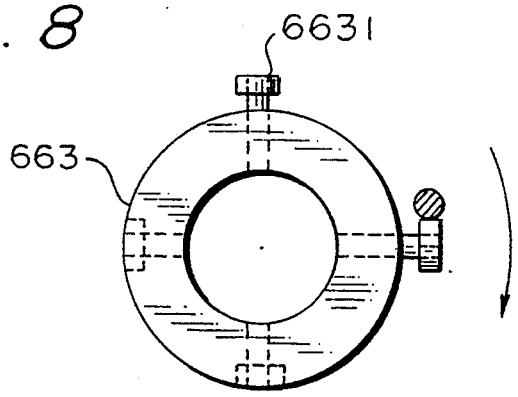
FIG. 8 shows a state of the fast locating means thereof.
Figure 9A:
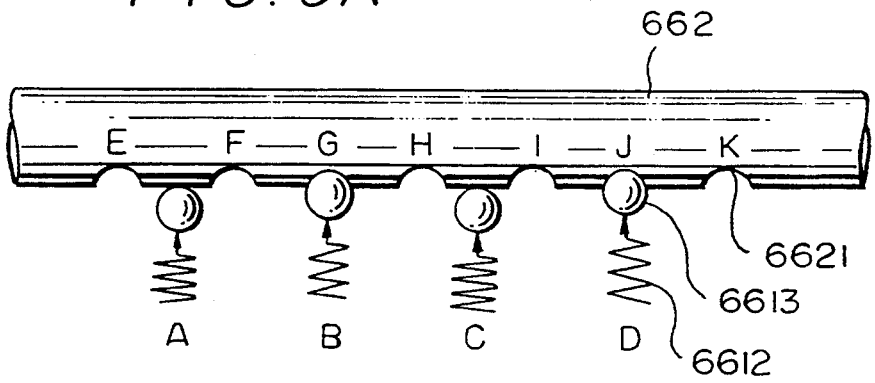
FIGS. 9A and 9B show other states of the fast locating means thereof.
Figure 9B:
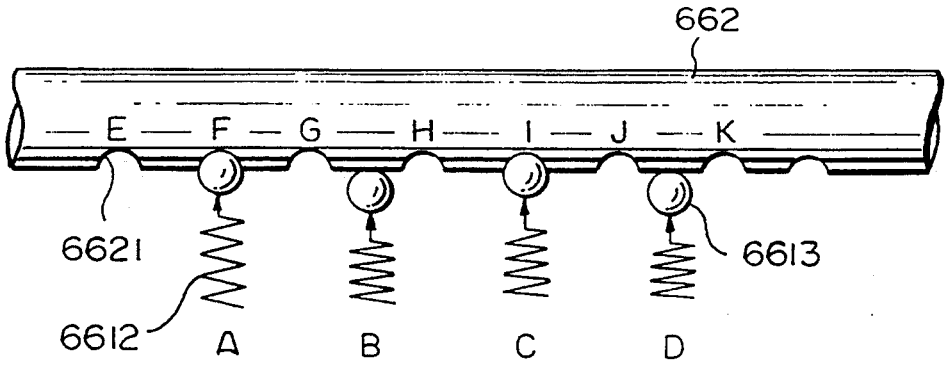

Please refer to FIGS. 1 to 3. The film-feeding system 5 includes a support body 50, a plastic film-guiding means 51, several film-guiding rods 52, a film-feeding motor 53 and a tension-adjusting mechanism 54 which is identical to a conventional one.

The plastic film-guiding means 51 includes a fixed roller shaft 511 and an adjustable roller shaft 512 disposed between two lateral sides of the support body 50. The fixed roller shaft 511 is parallel to and spaced from the adjustable roller shaft 512 by a certain distance, permitting a bare plastic film reel 90 to remain on the support body 50 without dropping down as well as preventing a full plastic film reel 90 from rolling down from the support body 50. Two movable restricting rods 514 are slidably disposed on a fixing lever 515 so as to restrict the plastic film reel 90 and permit the reel 90 to smoothly rotate. A stopper rod 516 is disposed above the fixing lever 515 for preventing the reel 90 from slipping away. Several copper wheels 517 and plastic wheels 518 are disposed on the film-guiding rod 52. Each copper wheel 517 is disposed with a conic projection 5171 for thrusting through the plastic film to form air outlet during the sealing operation. The plastic wheel 518 is disposed with an annular groove 5181 for receiving the conic projection 5171 of the copper wheel 517. A film-stretching rod 519 is disposed below the film-guiding rod 52 for stretching open the plastic film.

Please refer to FIGS. 4 to 9. The fast locating means 66 is mainly composed of a locating seat 661, a locating lever 662, a locating fixing ring 663 and a connecting fixing plate 664. The locating seat 661 is a rectangular body which is formed with through holes on two sides for the locating lever 662 to pass therethrough. In addition, several through holes are formed on a front face of the locating seat 661. A locating screw 6611 is screwed into a front half section of each of the through holes to prevent a spring 6612 and a steel ball 6613 located in a rear half section of the through hole from jumping out of the through hole. In addition, multiple thread holes are formed on a bottom face of the locating seat 661 for engaging with the connecting fixing plate 664. The locating rod 662 passes through the front conveying belt seat 62 and is formed with multiple equally spaced axial circular notches 6621. The locating fixing ring 663 has such an inner diameter that the locating rod 662 can pass therethrough. Moreover, multiple diametric thread holes are formed through the locating fixing ring 663 for fixing screws 6631 to screw thereinto corresponding to the circular notches of the locating rod. The connecting fixing plate 664 is substantially W-shaped and has elliptic slots 6641 on an upper and a lower end faces for engaging with the locating seat 661 and support body 60 by screws. A rotary wheel 601 is used to rotate the locating 662. Because the locating rod 662 contacts with the steel balls 6613 in the locating seat 661 at several points, the locating rod 662 can be quickly and easily moved without resistance. When it is desired to fix the locating rod 662, the rotary wheel 601 is further used to rotate the locating rod 662, making the circular notches 6621 thereof engaged with the steel balls 6613 to locate the locating rod 662. In addition, the distance between the circular notches 6621 of the locating rod 662 is smaller than and in proportion to the distance between the screws 6611 of the locating seats 661 so as to achieve a microadjusting effect.

Figure 10:
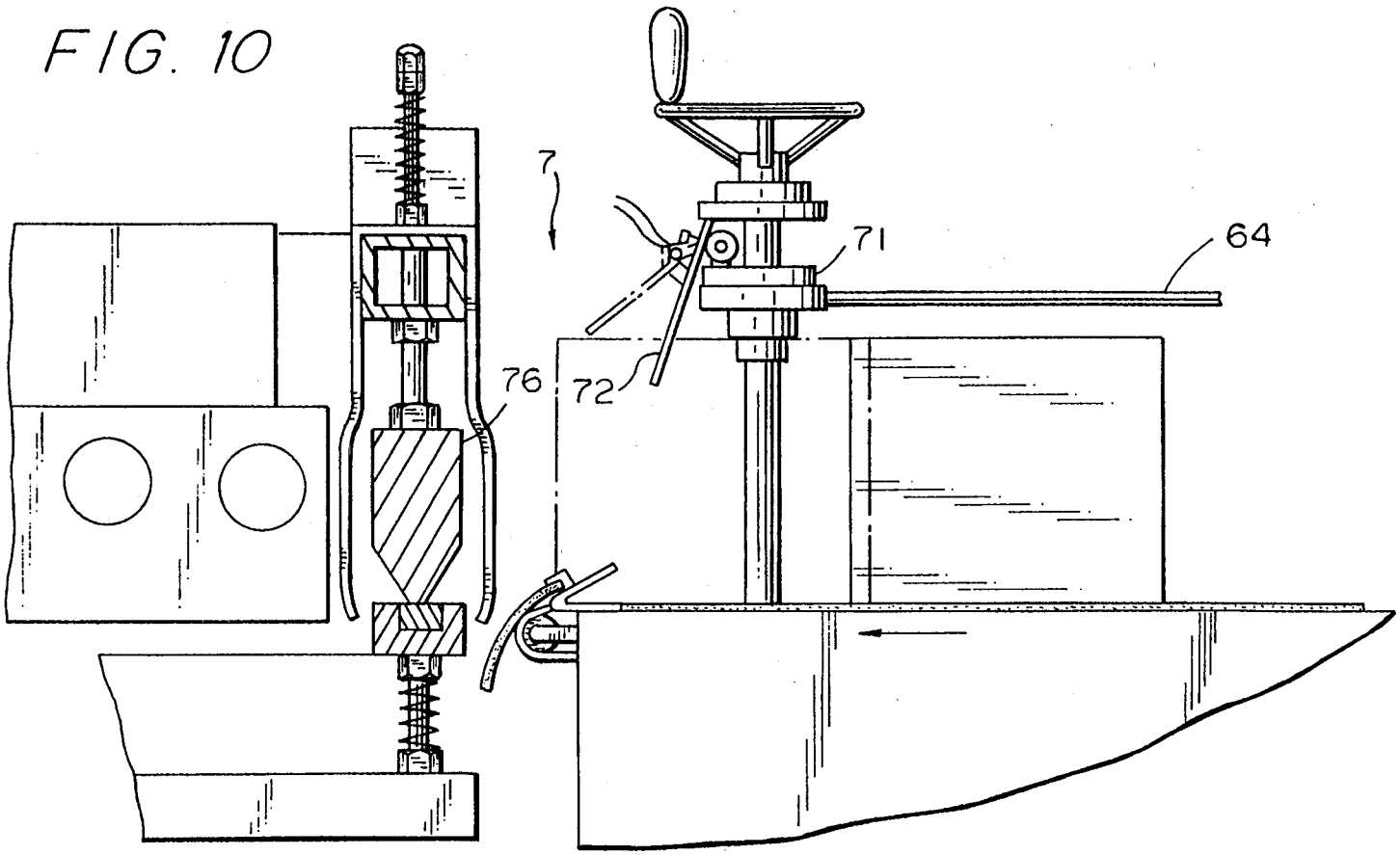
FIG. 10 shows the movement of the sensing means of the present invention.
Figure 11:
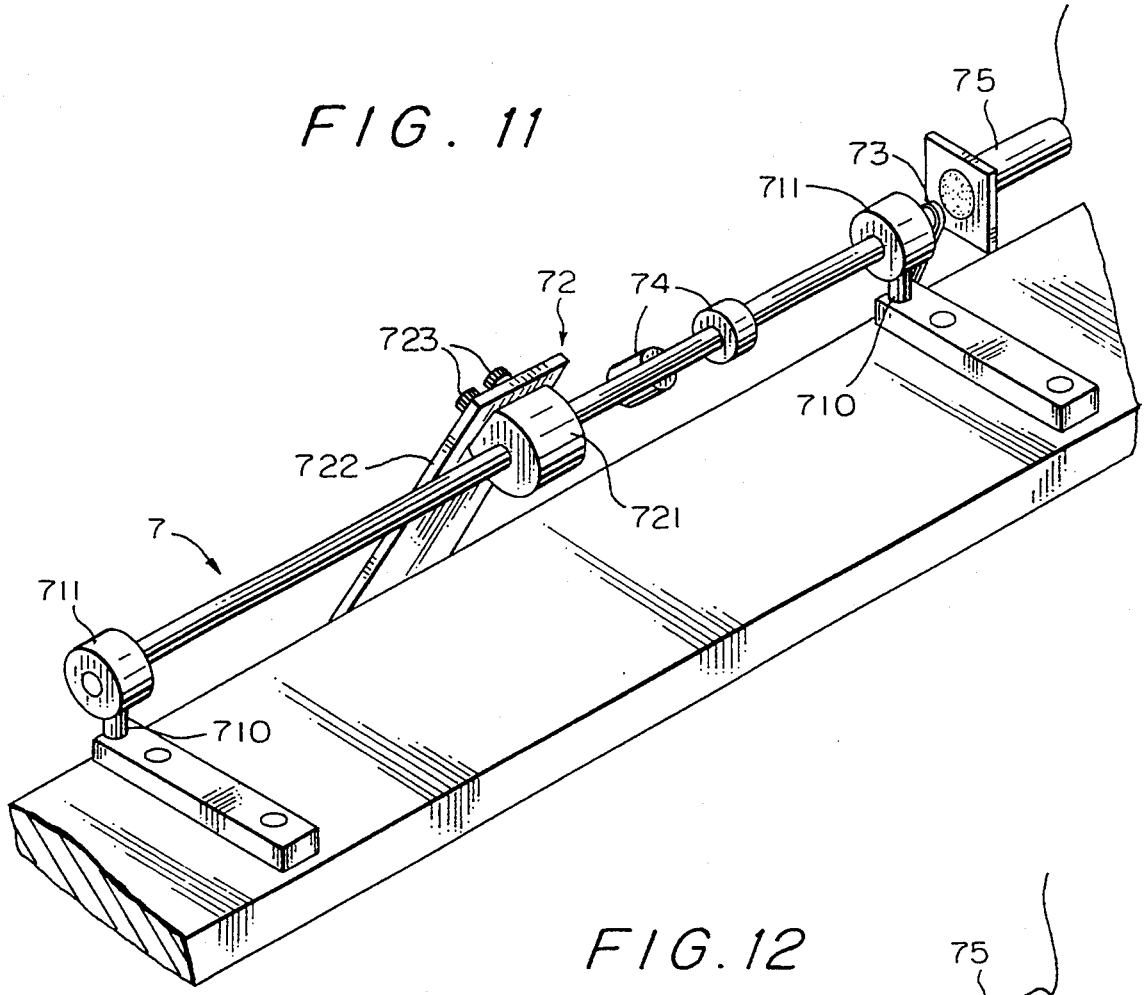
FIG. 11 is a perspective view of the sensing means thereof.
Figure 12:
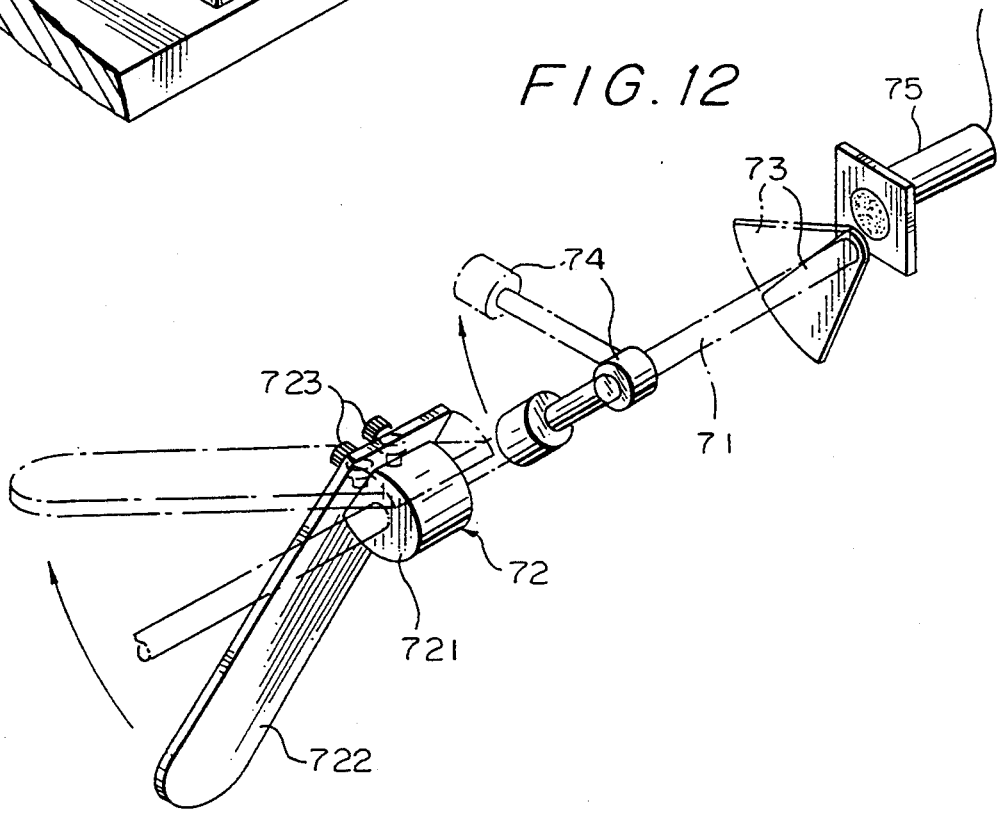
FIG. 12 is an enlarged view showing the movement of the sensing means thereof.

Please refer to FIGS. 10 to 12. The sensing means 7 is mainly composed of a fixing seat 71, a close contact block 72, a shade board 73, a weight block 74 and a close contact switch 75. The fixing seat 71 is fixed on a fixing support of the upper triangular support 64 beside the upper sealing blade. Two support seats 710 are fixedly disposed at two ends of the fixing seat 71. A sleeve ring 711 is disposed at a top end of the support seat 710. A rotary shaft 712 is fitted between the two sleeve rings 711. The shade board 73 is fixed at one end of the rotary shaft 712. The close contact block 72 is composed of a slide ring 721 and a close contact board 722. The slide ring 721 is fitted on the rotary shaft 712. A screw-fixed means 723 is disposed on the slide ring 721 to be fixed on the rotary shaft 712 by screws. The close contact board 722 is fixedly disposed on the slide ring 721.

The weight block 74 is disposed on the rotary shaft 712 beside the close contact block 72. The close contact switch 75 is disposed beside the fixing seat 71, whereby the shade board 73 disposed at one end of the rotary shaft 712 is swung to actuate the close contact switch 75.

According to the above arrangements, when the article passes through the sensing means 7, the close contact board 722 is swung upward and the shade board 73 is urged to swing and shade the close contact switch 75, whereby the upper and lower sealing blade,can seal the plastic film packing the article. The angle and position of the close contact block 72 on the rotary shaft 712 can be adjusted as necessary.

Figure 13:
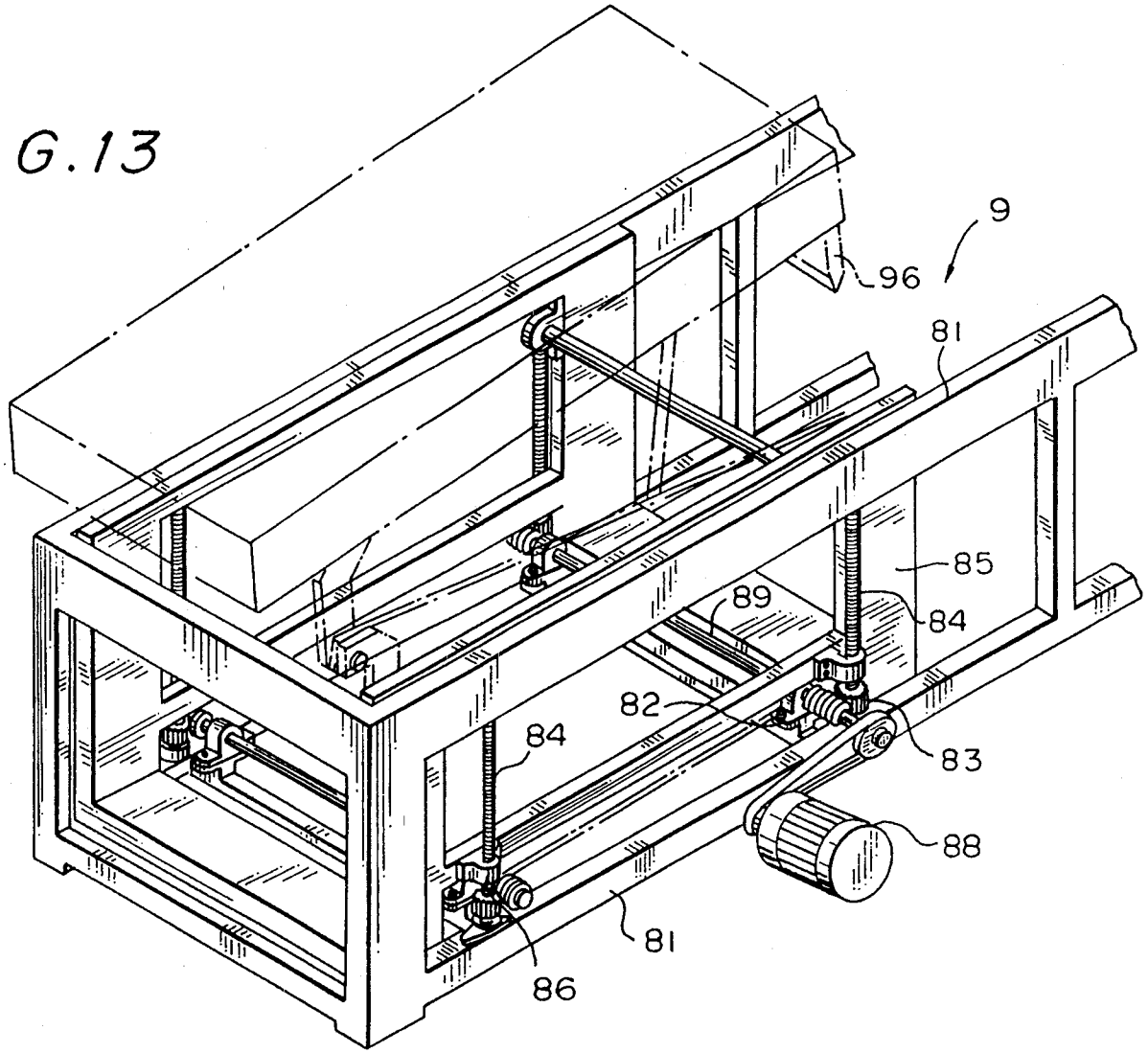
FIG. 13 is a perspective view of the elevator means of the present invention.
Figure 14:
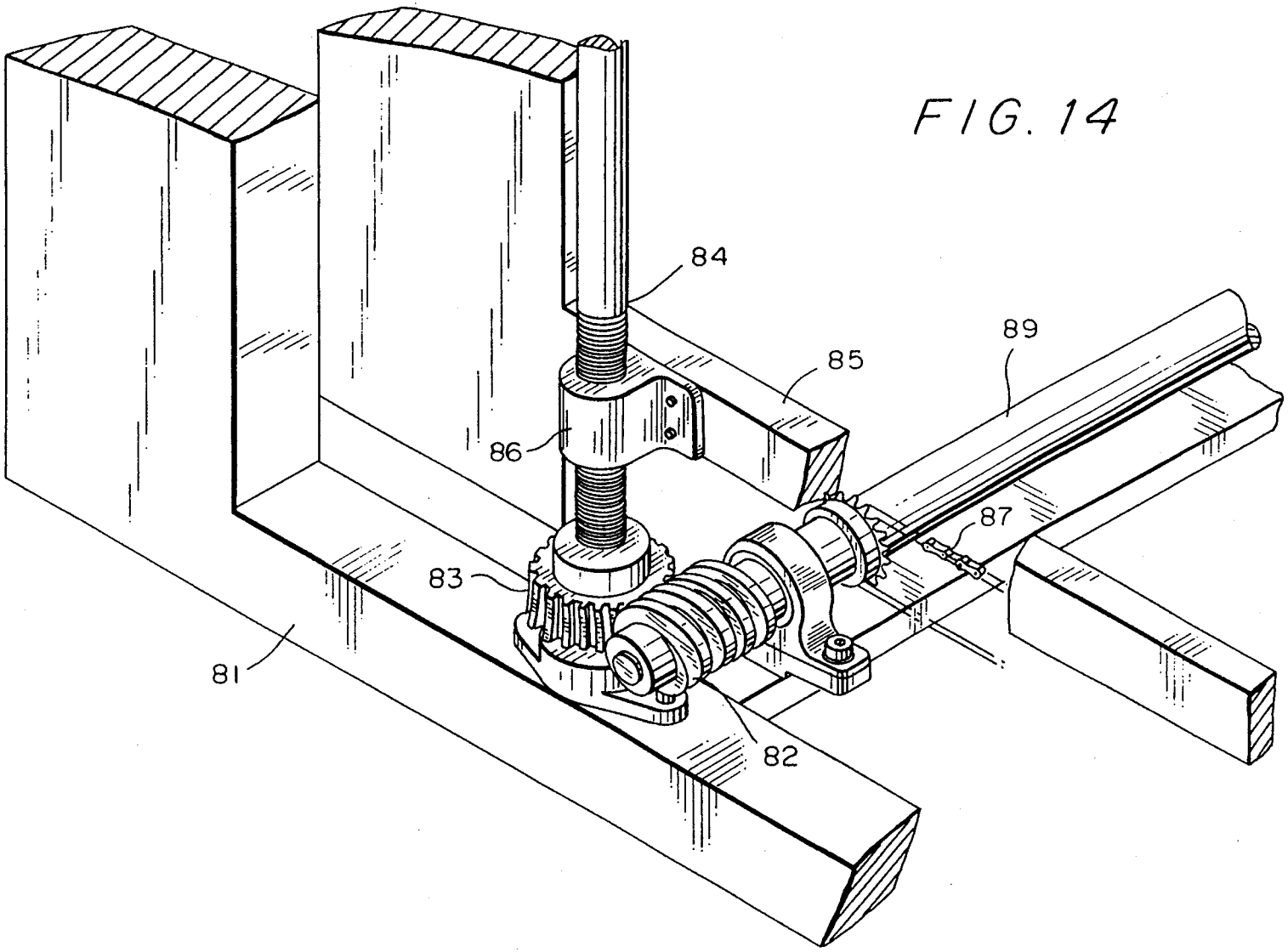
FIG. 14 is an enlarged view of a part of the elevator means thereof.
Figure 15:
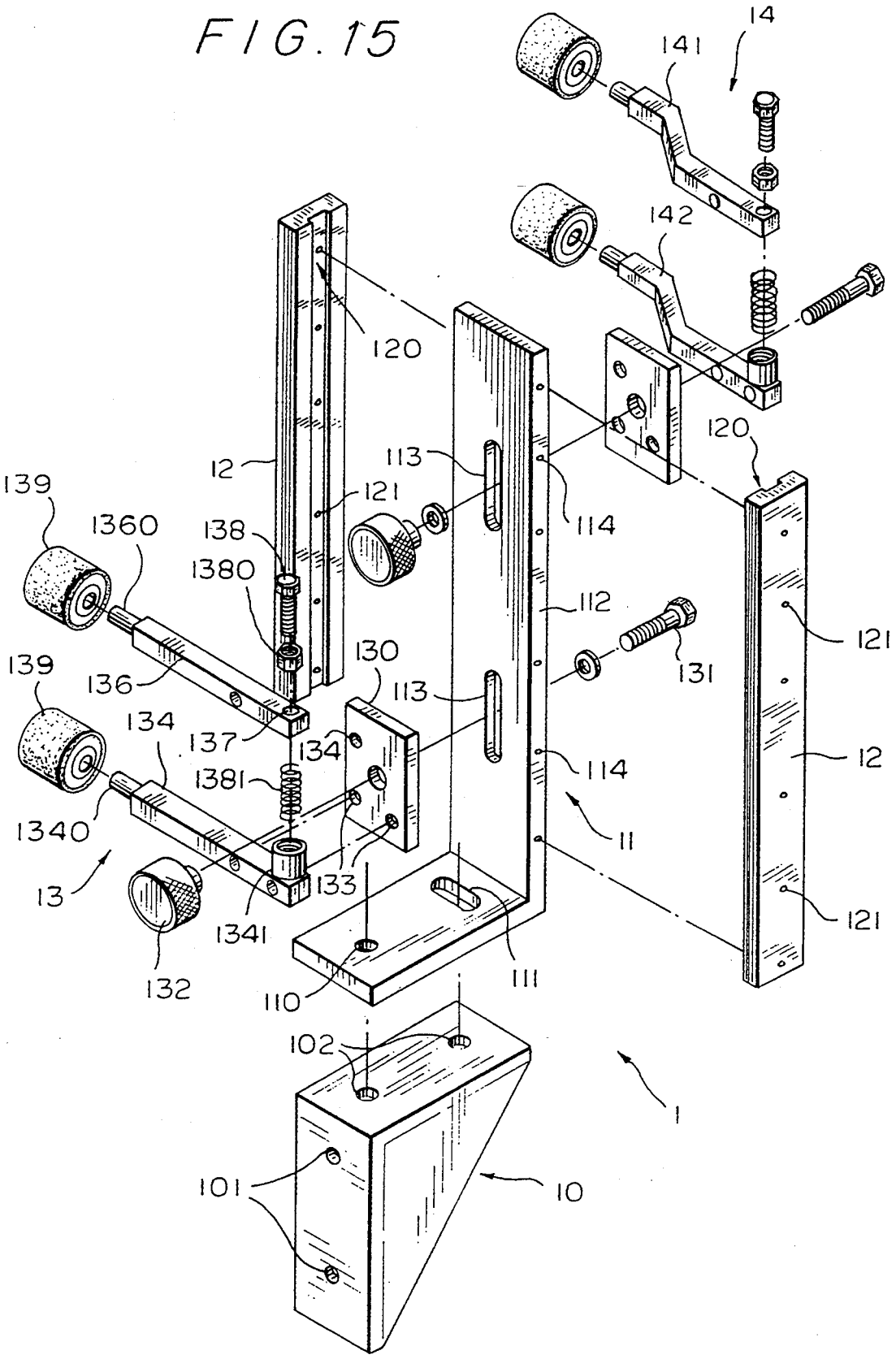
FIG. 15 is a perspective exploded view of the upper film-pulling seat of the auxiliary film-pulling means of the present invention.
Figure 16:
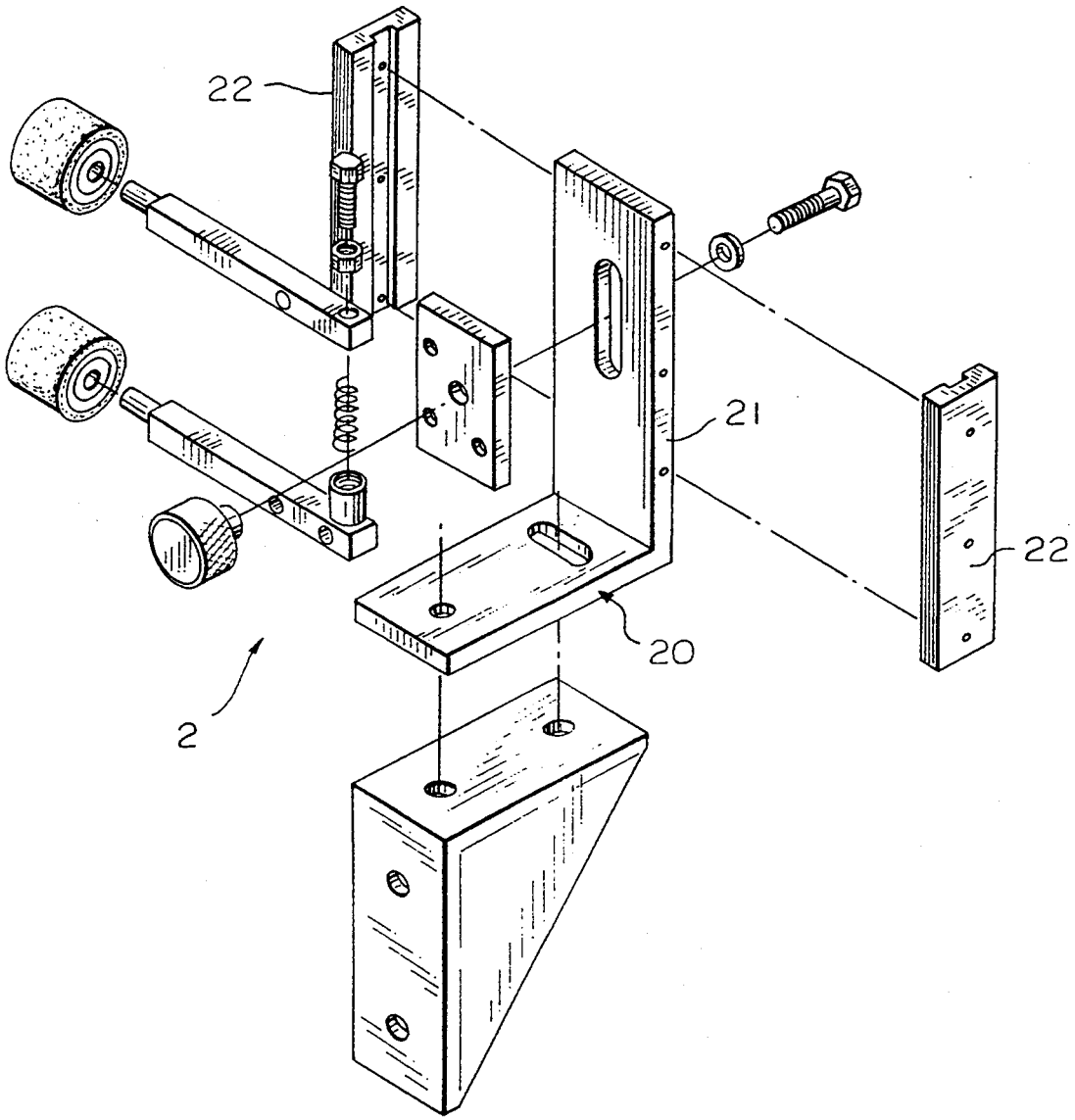
FIG. 16 is a perspective exploded view of the lower film-pulling seat of the auxiliary film-pulling means of the present invention.
Figure 17:
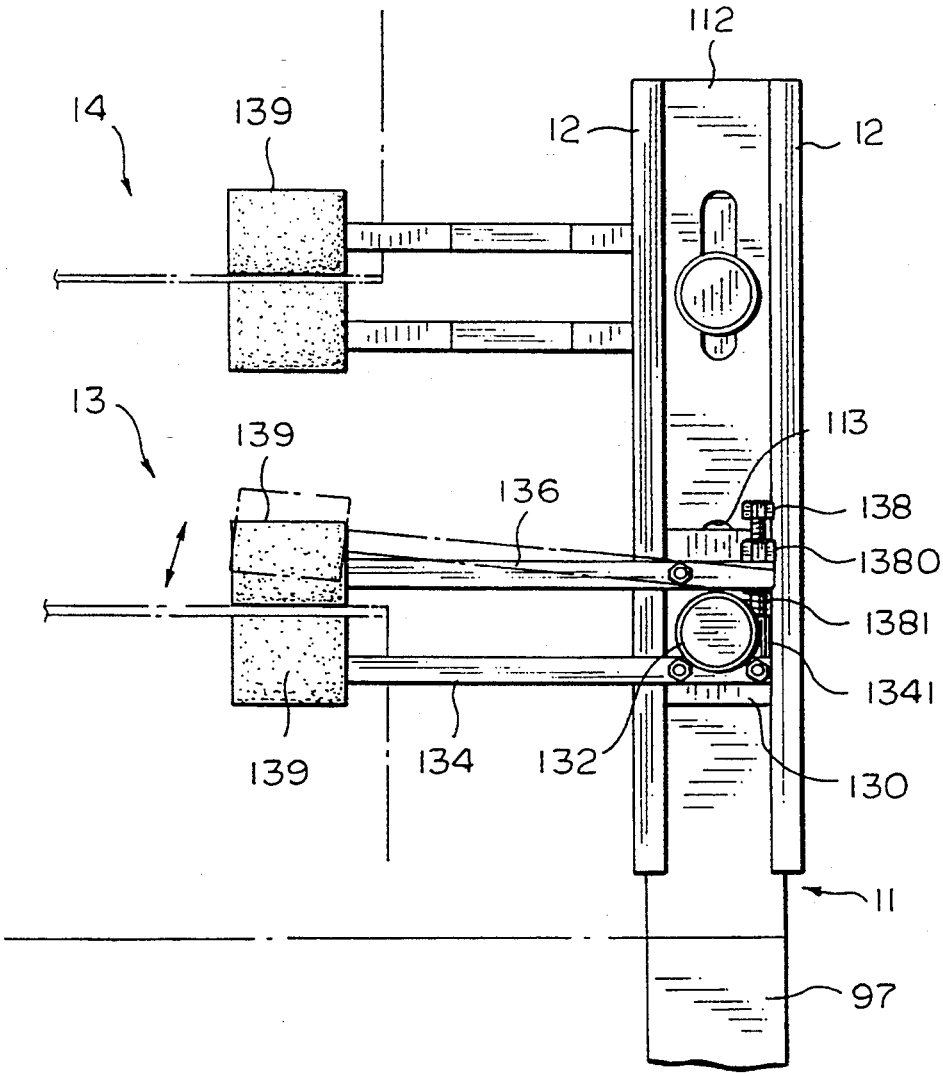
FIG. 17 shows the movement of the auxiliary film-pulling means thereof.
Figure 18:
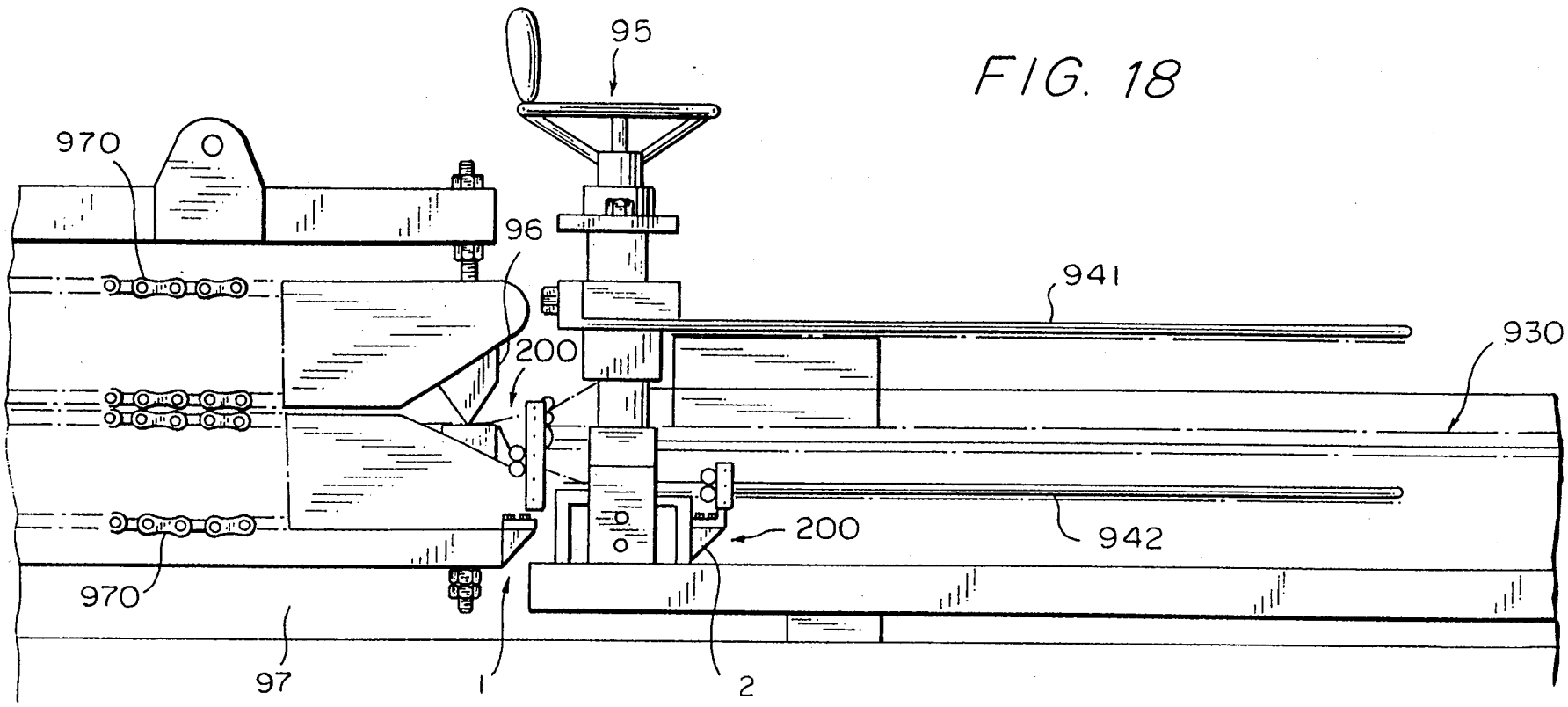
FIG. 18 shows the position of the auxiliary film-pulling means thereof.

Please refer to FIGS. 13 and 14. The elevator means 8 includes four assemblies of spiral rods 82 and spiral wheels 83 disposed at four corners of the support body 81. A thread rod 84 extends upward from each spiral wheel 83 and a movable seat 86 is screwed on the thread rod 84. The movable seat 86 is fixedly connected with the blade seat 85 and is able to move up and down along the thread rod 84. One spiral rod 82 is connected with another by a shaft rod 89 and a chain 87, whereby when one assembly of spiral rod 82 and spiral wheel 83 is driven by a motor 88, the other three assemblies of spiral rods 82 and spiral wheels 83 are rotated as well at the same rotary speed. Therefore, the blade seat 85 can ascend or descend along all of the thread rods 84 of the four spiral wheels 83. Accordingly, the height of the blade seat 85 can be controlled to meet the requirement of a relatively high article which is to be packed.

Please refer to FIGS. 15 to 18. The auxiliary film-pulling means 200 includes an upper and a lower film pulling seats 1 and 2. The upper film pulling seat 1 is composed of a fixing board 10, an upper support board 11, a lateral guide board 12 and an upper and a lower film pulling assemblies 13, 14. The fixing board 10 is an angle iron member, having a lateral face formed with two fixing through holes 101 and an upper face formed with two fixing through holes 102. The upper support board 11 is an L-shaped member, having a bottom portion formed with a circular fixing hole 110 and an arch slot 111 and a lateral portion 112 formed with two lengthwise adjusting slots 113. In addition, multiple thread holes 114 are formed on two sides of the lateral portion for fixing the lateral guide board 12 thereon by screws.

The lateral guide board 12 is formed with a channel 120 on which multiple through holes 121 are disposed corresponding to the thread holes 114 of the upper support board 11, whereby two lateral guide board 12 can be fixed on two sides of the upper support board 11 by screws.

The upper and lower film pulling assemblies 14, 13 include a fixing seat 130 which is fixed on the upper support board 11 by a screw 131 and a fixing nut 132. The fixing seat 130 is formed with three through holes. A rectangular lower support lever 134 is fixed at two lower through holes 133 of the three through holes by screws. A circular shaft rod 1340 extends from one end of the lower support lever 134 and a sleeve 1341 having inner thread is disposed at the other end of the lower support lever 134. A rectangular upper support lever 136 is pivotably fixed at the rest through hole 135 of the three through holes. A circular shaft rod 1360 extends from one end of the upper support lever 136 and a through hole 137 is formed at the other end of the upper support lever 136 for a fixing thread rod 138 to pass therethrough. An adjusting nut 1380 and a compression spring 1381 are fitted on the fixing thread rod 138 which is screwed into the sleeve 1341 of the lower support lever 134. Two pulling rollers 139 are respectively rotatably fixed at the shaft rods 134, 136 of the upper and lower support levers 136, 134. The two pulling rollers 139 engage with each other and the adjusting nut 1380 is used to adjust the clearance between the engaged pulling rollers 139. The fixing seats 10 of the upper and lower film pulling assemblies 14, 13 are respectively fixed at the upper and lower adjusting slots 113. The upper and lower support levers 141, 142 of the upper film pulling assembly 14 are slightly bent to a lateral side thereof.

The lower film pulling seat 2 is similar to the upper film pulling seat 1 in structure except that the lateral board 21 of the upper support board 20 is only disposed with one group of the components as those of the lower film pulling assembly 13 and the length of the lateral guide board 22 is changed according to that of the lateral board 21.

According to the above arrangements, the upper film pulling seat 1 is disposed between the front conveying belt 930 and the rear conveyor set 9 at the front end of the chain 970 for pulling the plastic film sent from the upper and lower triangular boards 941, 942. The lower film pulling seat 2 is disposed at the lower triangular board 942 of the front conveying belt 930 for pulling the plastic film and avoiding that an excessively large article cannot be totally clamped by the chain 970 to affect the cutting and sealing operation of the sealing blade 96. ulling mechanism 50. In addition, the adjusting nut 1380 is used to adjust the clearance between the engaged rollers 139 so that the plastic film can be more suitably pressed between the two rollers 139. After the fixing nut 132 is loosened, the fixing seat 130 can be freely positioned in the adjusting slot 113, whereby the distance between the upper and lower film pulling assemblies 14, 13 can be adjusted according to the shapes and sizes of the various articles to be packed.

Figure 19:
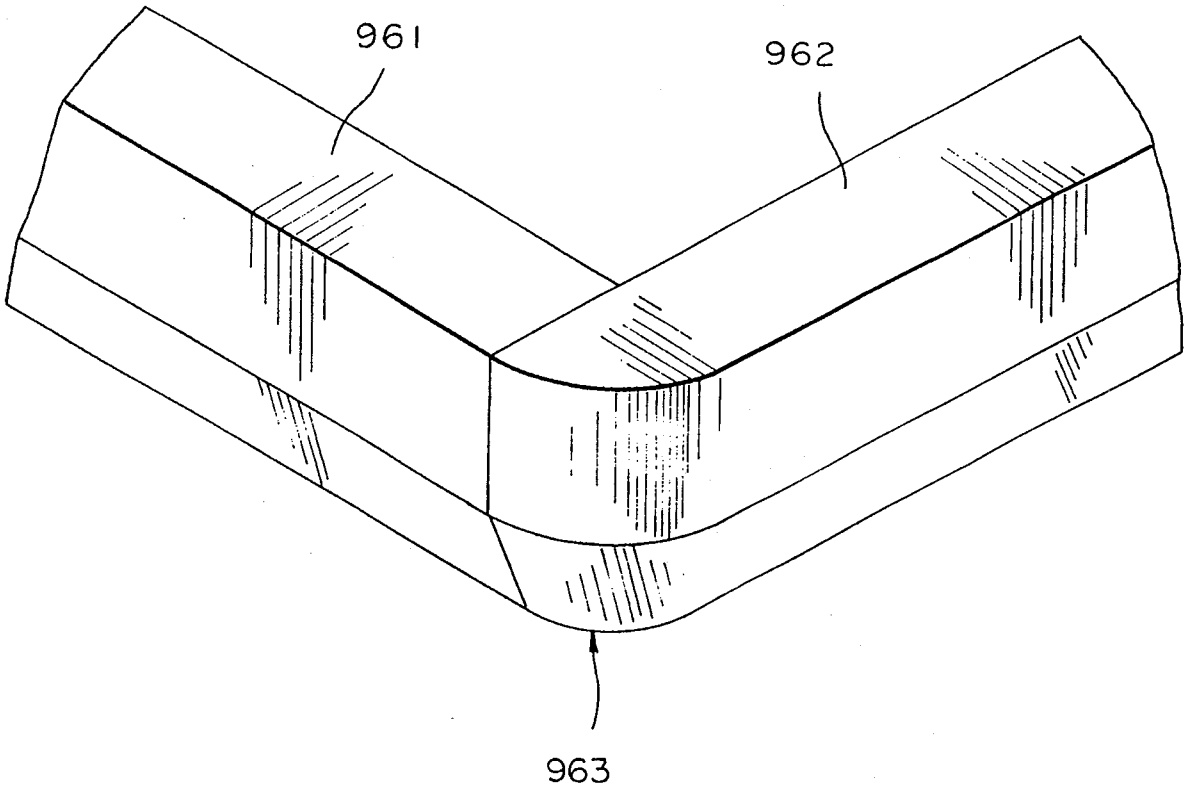
FIG. 19 is a perspective assembled view of the sealing blade of the present invention.

Please refer to FIG. 19. The sealing blade 96 of the rear conveyor set 9 is composed of a longitudinal and a transverse sealing blade members 961, 962. A joint portion 963 between the longitudinal and transverse sealing blade members 961, 962 is arch-shaped so as not to thrust the plastic film during the sealing operation.

Accordingly, the film-feeding system 5 serves to send out the plastic film to pass through the front conveyor set 6. The fast locating means 66 controls the back and forth movement of the front conveyor set 6 and the sensing means 7 is used to actually sense the article for the sealing operation. The auxiliary film-pulling means 200 is used to ensure that the plastic film is conveyed smoothly. The plastic film will not be thrusted by the arch joint portion 963 of the sealing blade 96. A waste stock collecting wheel is used to collect the cut away plastic film after the sealing operation.

The above embodiment is used for illustration purpose only. The invention should not be limited to this embodiment. Any modification or variation derived from the embodiment should fall within the scope of the present invention.

What is claimed is:

1. An automatic packing and sealing machine comprising a film-feeding system a front conveyor set a sensing means, an elevator means, a rear conveyor set, a fast locating means, a control means and an auxiliary film-pulling means, wherein:

the film-feeding system includes a support body, a plastic film-guiding means, several film-guiding rods, a film-feeding motor and a tension-adjusting mechanism;

the plastic film-guiding means includes a fixed roller shaft and an adjustable roller shaft disposed between two lateral sides of the support body, the fixed roller shaft being parallel to and spaced from the adjustable roller shaft by a certain distance, permitting a bare plastic film reel to remain on the support body without dropping down as well as preventing a full plastic film reel from rolling down from the support body, two movable restricting rods being slidably disposed on a fixing lever so as to restrict the plastic film reel and permit the reel to smoothly rotate, a stopper rod being disposed above the fixing lever for preventing the reel from slipping away, several copper wheels and plastic wheels being disposed on the film-guiding rod, each copper wheel being-disposed with a conic projection for thrusting through the plastic film to form air outlet during the sealing operation, the plastic wheel being disposed with an annular groove for receiving the conic projection of the copper wheel, a film-stretching rod being disposed below the film-guiding rod for stretching open the plastic film;

the fast locating means is mainly composed of a locating seat, a locating lever, a locating fixing ring and a connecting fixing plate, the locating seat being a rectangular body which is formed with through holes on two sides for the locating lever to pass therethrough, several through holes being formed on a front face of the locating seat, a locating screw being screwed into a front half section of each of the through holes to prevent a spring and a steel ball located in a rear half section of the through hole from jumping out of the through hole, multiple thread holes being formed on a bottom face of the locating seat for engaging with the connecting fixing plate, the locating rod passing through the front conveying belt seat and being formed with multiple equally spaced axial circular notches, the locating fixing ring having such an inner diameter that the locating rod can pass therethrough, multiple diametric thread holes being formed through the locating fixing ring for fixing screws to screw thereinto corresponding to the circular notches of the locating rod, the connecting fixing plate being substantially W-shaped and having elliptic slots on an upper and a lower end faces for engaging with the locating seat and support body by screws, a rotary wheel being used to rotate the locating rod, whereby because the locating rod contacts with the steel balls in the locating seat at several points, the locating rod can be quickly and easily moved without resistance, the locating rod being fixed in such a manner that the rotary wheel is used to rotate the locating rod, making the circular notches thereof engaged with the steel balls to locate the locating rod, the distance between the circular notches of the locating rod being smaller than and in proportion to the distance between the screws of the locating seats so as to achieve a microadjusting effect;

the sensing means is mainly composed of a fixing seat, a close contact block, a shade board, a weight block and a close contact switch, the fixing seat being fixed on a fixing support of the upper triangular support beside the upper sealing blade, two support seats being fixedly disposed at two ends of the fixing seat, a sleeve ring being disposed at a top end of the support seat, a rotary shaft being fitted between the two sleeve rings, the shade board being fixed at one end of the rotary shaft, the close contact block being composed of a slide ring and a close contact board, the slide ring being fitted on the rotary shaft, a screw-fixed means being disposed on the slide ring to be fixed on the rotary shaft by screws, the close contact board being fixedly disposed on the slide ring;

the weight block is disposed on the rotary shaft beside the close contact block, the close contact switch being disposed beside the fixing seat, whereby the shade board disposed at one end of the rotary shaft is swung to actuate the close contact switch, whereby, when the article passes through the sensing means, the close contact board is swung upward and the shade board is urged to swing and shade the close contact switch, so that the upper and lower sealing blade can seal the plastic film packing the article, the angle and position of the close contact block on the rotary shaft being adjustable;

the elevator means includes four assemblies of spiral rods and spiral wheels disposed at four corners of the support body, a thread rod extending upward from each spiral wheel and a movable seat being screwed on the thread rod, the movable seat being fixedly connected with the blade seat and able to move up and down along the thread rod, one spiral rod being connected with another by a shaft rod and a chain, whereby when one assembly of spiral rod and spiral wheel is driven by a motor, the other three assemblies of spiral rods and spiral wheels are rotated as well at the same rotary speed, so that the blade seat is able to ascend or descend along all of the thread rods of the four spiral wheels;

the film pulling mechanism includes an upper and a lower film pulling seats, the upper film pulling seat being composed of a fixing board, an upper support board, a lateral guide board and an upper and a lower film pulling assemblies, the fixing board being an angle iron member, having a lateral face formed with two fixing through holes and an upper face formed with two fixing through holes, the upper support board being an L-shaped member, having a bottom portion formed with a circular fixing hole and an arch slot and a lateral portion formed with two lengthwise adjusting slots, multiple thread holes being formed on two sides of the lateral portion for fixing the lateral guide board thereon by screws;

the lateral guide board is formed with a channel on which multiple through holes are disposed corresponding to the thread holes of the upper support board, whereby two lateral guide board is able to be fixed on two sides of the upper support board by screws; and the upper and lower film pulling assemblies include a fixing seat which is fixed on the upper support board by a screw and a fixing nut, the fixing seat being formed with three through holes, a rectangular lower support lever being fixed at two lower through holes of the three through holes by screws, a circular shaft rod extending from one end of the lower support lever and a sleeve having inner thread being disposed at the other end of the lower support lever, a rectangular upper support lever being pivotably fixed at the rest through hole of the three through holes, a circular shaft rod extending from one end of the upper support lever and a through hole being formed at the other end of the upper support lever for a fixing thread rod to pass therethrough, an adjusting nut and a compression spring being fitted on the fixing thread rod which is screwed into, the sleeve of the lower support lever, two pulling rollers being respectively rotatably fixed at the shaft rods of the upper and lower support levers, the two pulling rollers engaging with each other, the fixing seats of the upper and lower film pulling assemblies being respectively fixed at the upper and lower adjusting slots, the upper and lower support levers of the upper film pulling assembly being slightly bent to a lateral side thereof, the lower film pulling seat being similar to the upper film pulling seat in structure except that the lateral board of the upper support board is only disposed with one group of the components as those of the lower film pulling assembly and the length of the lateral guide board is changed according to that of the lateral board, whereby the film-feeding system serves to send out the plastic film to pass through the front conveyor set, and the fast locating means controls the back and forth movement of the front conveyor set and the sensing means is used to actually sense the article for the sealing operation, the auxiliary film-pulling means being used to ensure that the plastic film is conveyed smoothly, the plastic film being prevented from being thrusted by the arch joint portion of the sealing blade, a waste stock collecting wheel being used to collect the cut away plastic film after the sealing operation.

* * * * *